US011506469B2

(12) United States Patent
Lee

(10) Patent No.: US 11,506,469 B2
(45) Date of Patent: Nov. 22, 2022

(54) PACK TYPE BODY ARMOR

(71) Applicant: Zeon Quan Technology Co., Ltd., Kaohsiung (TW)

(72) Inventor: Hsing Hsun Lee, Kaohsiung (TW)

(73) Assignee: ZEON QUAN TECHNOLOGY CO., LTD., Kaohsiung (TW)

( * ) Notice: Subject to any disclaimer, the term of this patent is extended or adjusted under 35 U.S.C. 154(b) by 87 days.

(21) Appl. No.: 17/088,632

(22) Filed: Nov. 4, 2020

(65) Prior Publication Data

US 2022/0099411 A1 Mar. 31, 2022

(30) Foreign Application Priority Data

Sep. 25, 2020 (TW) ..... 109133366

(51) Int. Cl.
*F41H 1/02* (2006.01)
*A45F 4/02* (2006.01)

(52) U.S. Cl.
CPC ..... *F41H 1/02* (2013.01); *A45F 4/02* (2013.01)

(58) Field of Classification Search
CPC ..... F41H 1/02; A45F 4/02
USPC ..... 89/36.05
See application file for complete search history.

(56) References Cited

U.S. PATENT DOCUMENTS

| | | | | |
|---|---|---|---|---|
| 9,820,558 | B1 * | 11/2017 | de Geus | F41H 1/02 |
| 10,098,441 | B1 * | 10/2018 | Holloman | A45F 3/06 |
| 10,231,533 | B2 * | 3/2019 | Vaughan | A45F 3/06 |
| 10,306,971 | B2 * | 6/2019 | Zhang | A45F 3/04 |
| 10,939,713 | B2 * | 3/2021 | Walsh | A45C 9/00 |
| 11,181,343 | B2 * | 11/2021 | Ross | F41H 1/02 |
| 2010/0212056 | A1 * | 8/2010 | Sullivan | F41H 1/02 2/2.5 |
| 2011/0004968 | A1 * | 1/2011 | Morgan | B63C 9/135 2/2.5 |
| 2015/0196077 | A1 * | 7/2015 | McIntire, Jr. | A41D 15/04 2/2.5 |
| 2017/0318941 | A1 * | 11/2017 | Vaughan | F41H 1/02 |
| 2019/0133303 | A1 * | 5/2019 | Thiel | H02J 7/35 |
| 2019/0174903 | A1 * | 6/2019 | Holder | A45F 3/06 |
| 2021/0000246 | A1 * | 1/2021 | Alson | A45F 4/02 |
| 2021/0078263 | A1 * | 3/2021 | Wang | B32B 7/09 |
| 2021/0292967 | A1 * | 9/2021 | Gigrich | D02G 3/443 |

* cited by examiner

*Primary Examiner* — Samir Abdosh
(74) *Attorney, Agent, or Firm* — WPAT, PC

(57) ABSTRACT

A pack type body armor includes: first and second pack bodies, wherein when the pack type body armor has the function of a pack, each side of the first pack body and each side of the second pack body are detachably connected by a first connecting element; and when the pack type body armor has the function of a bullet-proof cloth, the first and second pack bodies are detachably connected by a second connecting element.

9 Claims, 4 Drawing Sheets

PACK TYPE BODY ARMOR

CROSS-REFERENCE TO RELATED APPLICATION

This application claims the benefit of Taiwan Patent Application No. 109133366, filed on Sep. 25, 2020, which is hereby incorporated by reference for all purposes as if fully set forth herein.

BACKGROUND

Technical Field

The present disclosure relates to a pack type body armor, and particularly, to a pack type body armor having both the function of a pack and the function of a bullet-proof cloth.

Related Art

A pack is mainly used for holding things, is convenient to take out, and is widely used in social life. As the times continuously develops and social conditions change day by day, requirements for a pack are no longer limited to carrying things, and requirements for functions of the pack itself are increasingly high.

However, existing pack products generally do not have a bullet-proof function. When an accidence, a war, or a terrorist event occurs, users cannot be protected effectively, and are likely to be injured when dangers occur. Especially, a military pack or a police pack has no bullet-proof function other than carrying military equipment, and combatants should be equipped with bullet-proof clothes separately. Therefore, when an emergency occurs, the combatants cannot participate in the battle immediately, resulting in inconvenience, and casualties and property loss are likely to be caused.

Based on the foregoing situation, currently, there are various safety protective equipment on the market for people to choose and use. A conventional bullet-proof pack includes a pack body. The pack body includes a wear-resistant layer located outside the pack body, wherein the wear-resistant layer is provided with an interlayer, and the interlayer is provided with a bulletproof layer. The bullet-proof layer is made of soft materials. In another example, a conventional multi-function outdoor pack also includes a pack body. To make the pack also have a bullet-proof function, a bullet-proof layer, and a foam board are fixed in sequence from inside to outside in the pack body. In view of this, after being equipped with a bullet-proof layer, the foregoing two packs with different structures both have the bullet-proof function, can be used as personal protective equipment, and have specific effects in safeguarding life safety.

However, because the bullet-proof layer is fixed in the pack body, regardless of whether a user carries the pack body on the back or hangs the pack body on the chest, the back and the chest of the user cannot be protected at the same time.

Therefore, there is a need to provide a pack type body armor to resolve the foregoing problems.

SUMMARY

An objective of the present disclosure is to provide a pack type body armor having both the function of a pack and the function of a bullet-proof cloth.

Another objective of the present disclosure is to provide a pack type body armor, capable of reducing bacterial breeding in first and second pack bodies caused by sweating of the body of a user.

Still another objective of the present disclosure is to provide a pack type body armor, capable of providing buoyancy, so that the pack type body armor can be used as a simple life jacket.

According to the foregoing objectives, the present disclosure provides a pack type body armor, including: first and second pack bodies, wherein when the pack type body armor has the function of a pack, each side of the first pack body and each side of the second pack body are detachably connected by a first connecting element; and when the pack type body armor has the function of a bullet-proof cloth, the first and second pack bodies are detachably connected by a second connecting element.

The present disclosure further provides a pack type body armor, including: first and second pack bodies, separately including a cut-resistant material layer, a bulletproof material layer, and an antibacterial material layer arranged in sequence; at least one zipper, configured to detachably connect the first pack body to the second pack body, and disposed on each side of the first pack body and each side of the second pack body; and two shoulder belts and two waist belts, configured to detachably connect the first pack body to the second pack body, wherein the two shoulder belts are first and second shoulder belts, the first and second shoulder belts are both disposed near first sides of the first and second pack bodies, the two waist belts are first and second waist belts, the first waist belt is disposed near second sides of the first and second pack bodies, the second waist belt is disposed near third sides of the first and second pack bodies, and the second sides are opposite to the third sides.

A feature of the pack type body armor in the present disclosure is as follows: The pack type body armor has both the function of a pack and the function of a bullet-proof cloth. Further, because the antibacterial material layer of the pack type body armor is disposed near the body of a user, bacterial breeding in the first and second pack bodies caused by sweating of the body of the user can be reduced, thereby further reducing the stink produced by sweating of the user in a conventional bullet-proof cloth. When the user is drowning, first and second buoyancy elements of the pack type body armor can provide buoyancy, so that the pack type body armor can be used as a simple life jacket.

DETAILED DESCRIPTION

To make the foregoing objectives and features of the present disclosure more obvious and comprehensible, related embodiments of the present disclosure are described in detail below with reference to the accompanying drawings.

Figure 1:
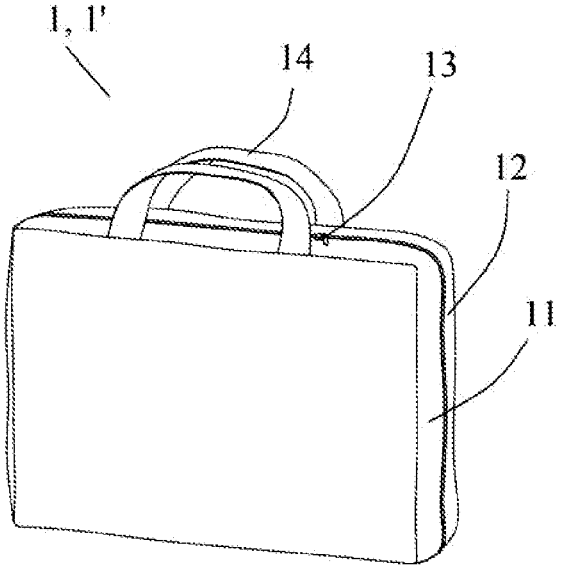
FIG. 1 is a schematic three-dimensional view of a pack type body armor according to an embodiment of the present disclosure when the pack type body armor is closed.

FIG. 1 is a schematic three-dimensional view of a pack type body armor according to an embodiment of the present disclosure when the pack type body armor is closed. The pack type body armor 1 includes first and second pack bodies 11 and 12. Referring to FIG. 1, when the pack type body armor 1' needs to have the function of a pack 1' (that is, in this case, the pack type body armor 1 can be regarded as the pack 1" capable of holding things), each side of the first pack body 11 and each side of the second pack body 12 are detachably connected by a first connecting element (including at least one zipper 13). For example, the zipper 13 is disposed on each side of the first pack body 11 and each side of the second pack body 12, and the zipper 13 enables the detachable connection between each side of the first pack body 11 and each side of the second pack body 12 to be an engagement connection, to further close or open the pack 1'. In this embodiment, if the first and second pack bodies 11 and 12 are both rectangular, then four sides of the first pack body 11 and four sides of the second pack body 12 are connected in engagement manner through the zipper. In another embodiment, the four sides of the first pack body 11 and the four sides of the second pack body 12 may accelerate the engagement connection by using two zippers 13. The pack 1' refers to a handbag (for example, a carrying ring 14 shown in FIG. 1 can be used for carrying), a single shoulder strap pack, a double shoulder strap pack, or another portable bag capable of holding things.

Figure 2:
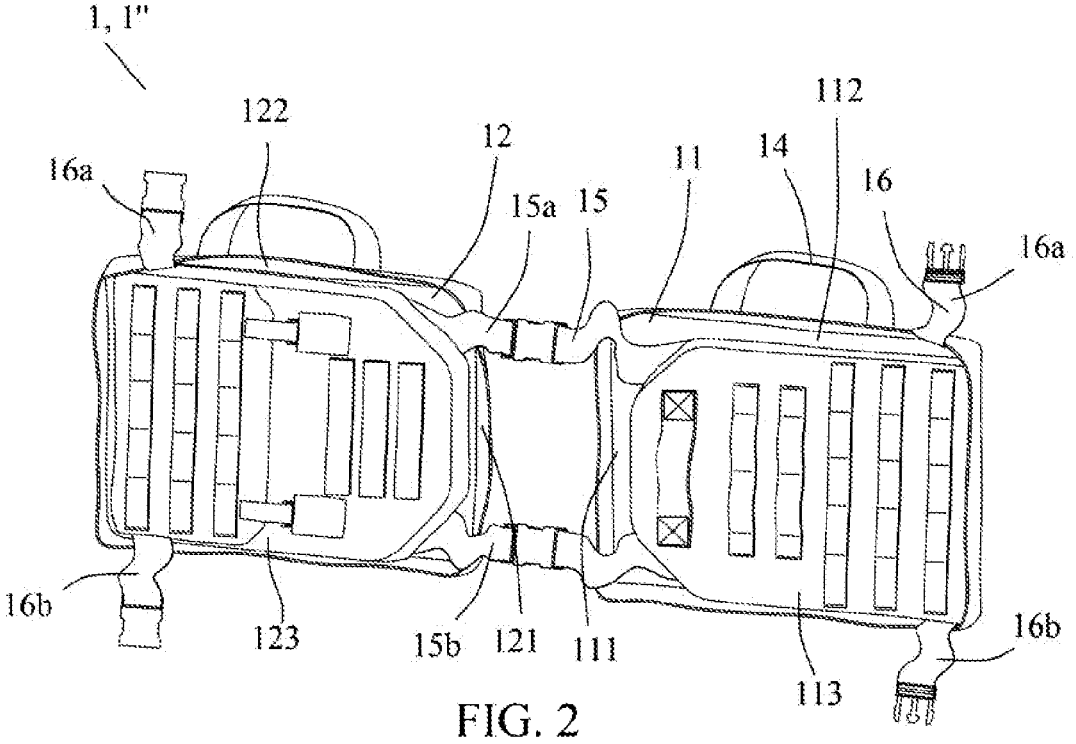
FIG. 2 is a schematic three-dimensional view of a pack type body armor according to an embodiment of the present disclosure when the pack type body armor is opened, showing that the pack type body armor has not been fixed on the body of a user.

FIG. 2 is a schematic three-dimensional view of a pack type body armor according to an embodiment of the present disclosure when the pack type body armor is opened, showing that the pack type body armor has not been fixed on the body of a user; referring to FIG. 2, when the pack type body armor 1 needs to have the function of a bullet-proof cloth 1" (that is, in this case, the pack type body armor 1 can be regarded as the bullet-proof cloth 1"), the first and second pack bodies 11 and 12 are detachably connected by a second connecting element (including two shoulder belts 15 and two waist belts 16). The two shoulder belts 15 enable the detachable connection between the first and second pack bodies 11 and 12 to be a release-buckle connection, a sticky-buckle connection (that is, a Velcro connection), or another connection manner. The two waist belts 16 enable the detachable connection between the first and second pack bodies 11 and 12 to also be a release-buckle connection, a sticky-buckle connection, or another connection manner. The two shoulder belts 15 are first and second shoulder belts 15*a* and 15*b*. The first and second shoulder belts 15*a* and 15*b* are both disposed near first sides 111 and 121 of the first and second pack bodies 11 and 12. The two waist belts 16 are first and second waist belts 16*a* and 16*b*. The first waist belt 16*a* is disposed near second sides 112 and 122 of the first and second pack bodies 11 and 12, and the second waist belt 16*b* is disposed near third sides 113 and 123 of the first and second pack bodies 11 and 12. The second sides 112 and 122 are opposite to the third sides 113 and 123. If the first and second pack bodies 11 and 12 are both rectangular, the second sides 112 and 122, the first sides 111 and 121, and the third sides 113 and 123 are connected in sequence and arranged in a U shape.

Figure 3:
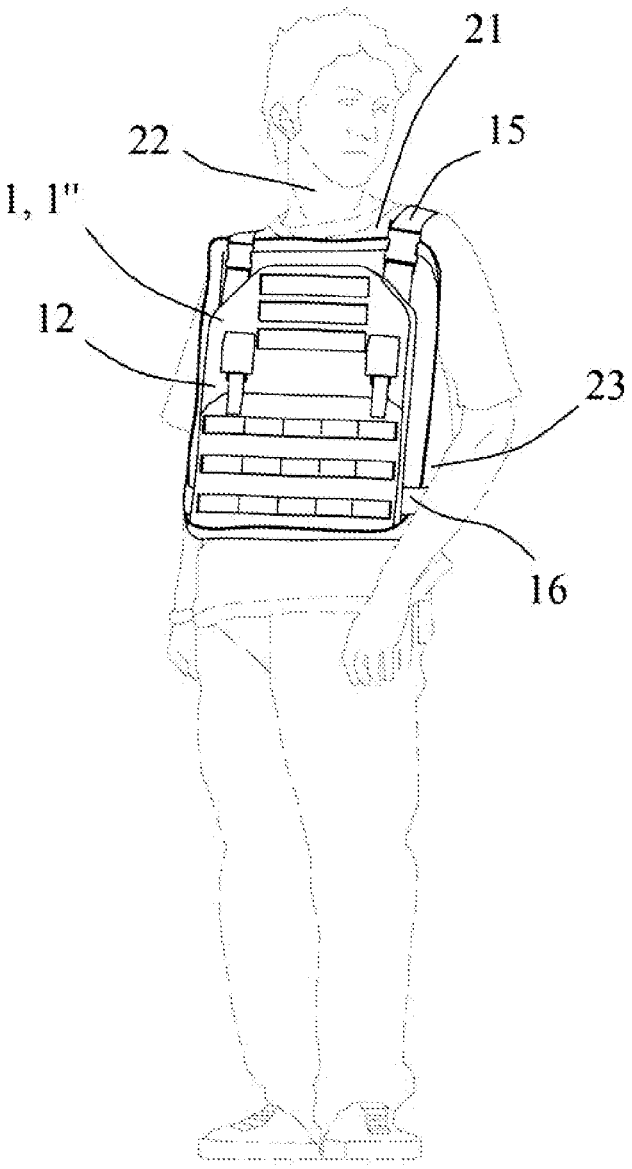
FIG. 3 is a schematic three-dimensional view of a pack type body armor according to an embodiment of the present disclosure when the pack type body armor is opened, showing that the pack type body armor is fixed on the body of a user.

FIG. 3 is a schematic three-dimensional view of a pack type body armor according to an embodiment of the present disclosure when the pack type body armor is opened, showing that the pack type body armor is fixed on the body of a user; Referring to FIG. 3 and FIG. 2, for example, the two shoulder belts 15 are the first and second shoulder belts 15*a* and 15*b* respectively located on both sides of the neck 22 of a user. The first shoulder belt 15*a* includes a first male buckle belt and a first female buckle belt, and the second shoulder belt 15*b* includes a second male buckle belt and a second female buckle belt. A release-buckle connection manner between the first male buckle belt and the first female buckle belt enables the first and second pack bodies 11 and 12 to be detachably connected. Similarly, a release-buckle connection manner between the second male buckle belt and the second female buckle belt enables the first and second pack bodies 11 and 12 to be detachably connected.

Still referring to FIG. 3 and FIG. 2, for example, the two waist belts 16 are the first and second waist belts 16*a* and 16*b* respectively located on both sides of the waist 23 of the user. The first waist belt 16*a* includes a third male buckle belt and a third female buckle belt, and the second waist belt 16*b* includes a fourth male buckle belt and a fourth female buckle belt. A release-buckle connection manner between the third male buckle belt and the third female buckle belt enables the first and second pack bodies 11 and 12 to be detachably connected. Similarly, a release-buckle connection manner between the fourth male buckle belt and the fourth female buckle belt enables the first and second pack bodies 11 and 12 to be detachably connected.

As stated above, the pack type body armor 1 in the present disclosure has both the function of the pack 1' and the function of the bullet-proof cloth 1". When the pack type body armor 1 needs to have the function of the pack 1', a user may open or close the pack 1' by using the zipper 13. When the pack type body armor 1 needs to have the function of the bullet-proof cloth 1", the pack 1' is fully opened by the zipper 13 first to become the bullet-proof cloth 1", and then a user fixes the body armor 1" on the body 21 of the user by using the two shoulder belts 15 and the two waist belts 16, so that the back and the chest of the body 21 of the user can be protected at the same time.

Figure 4A:
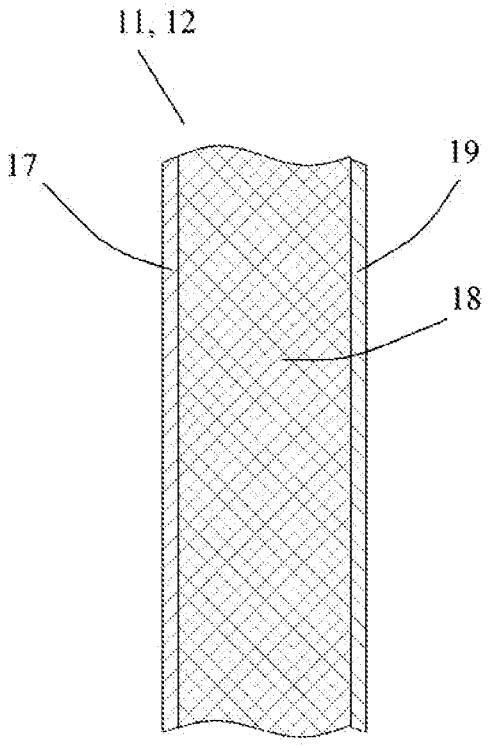
FIG. 4*a* is a schematic cross-sectional view of first and second pack bodies of a pack type body armor according to an embodiment of the present disclosure.

FIG. 4*a* is a schematic cross-sectional view of first and second pack bodies of a pack type body armor according to an embodiment of the present disclosure; Referring to FIG. 4*a* and FIG. 2, the first and second pack bodies 11 and 12 each include a cut-resistant material layer 17, a bullet-proof material layer 18, and an antibacterial material layer 19 arranged in sequence, and the antibacterial material layer 19 is disposed on a side near the body 21 of a user. In this embodiment, the cut-resistant material layer 17, the bullet-proof material layer 18, and the antibacterial material layer 19 are stacked in sequence. The cut-resistant material layer 17 is made of cut-resistant cloth, the bullet-proof material layer 18 is made of ultra-high molecular weight polyethylene fiber, and the antibacterial material layer 19 is made of copper fiber. Because the antibacterial material layer 19 is disposed near the body 21 of a user, bacterial breeding in the first and second pack bodies 11 and 12 caused by sweating of the body 21 of the user can be reduced, thereby further reducing the stink produced by sweating of the user in a conventional bullet-proof cloth.

Figure 4B:
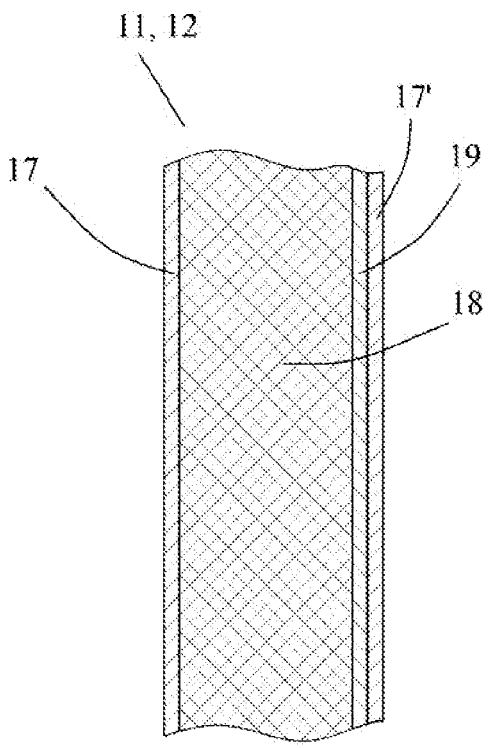
FIG. 4*b* is a schematic cross-sectional view of first and second pack bodies of a pack type body armor according to another embodiment of the present disclosure.

FIG. 4*b* is a schematic cross-sectional view of first and second pack bodies of a pack type body armor according to another embodiment of the present disclosure; and referring to FIG. 4*b*, the first and second pack bodies 11 and 12 each further include another cut-resistant material layer 17' used for covering the antibacterial material layer 19. The another cut-resistant material layer 17' is also made of cut-resistant cloth, so that outermost layers of front faces and back faces of the first and second pack bodies 11 and 12 are all made of cut-resistant cloth, leading to an integrally-formed appearance.

Figure 5:
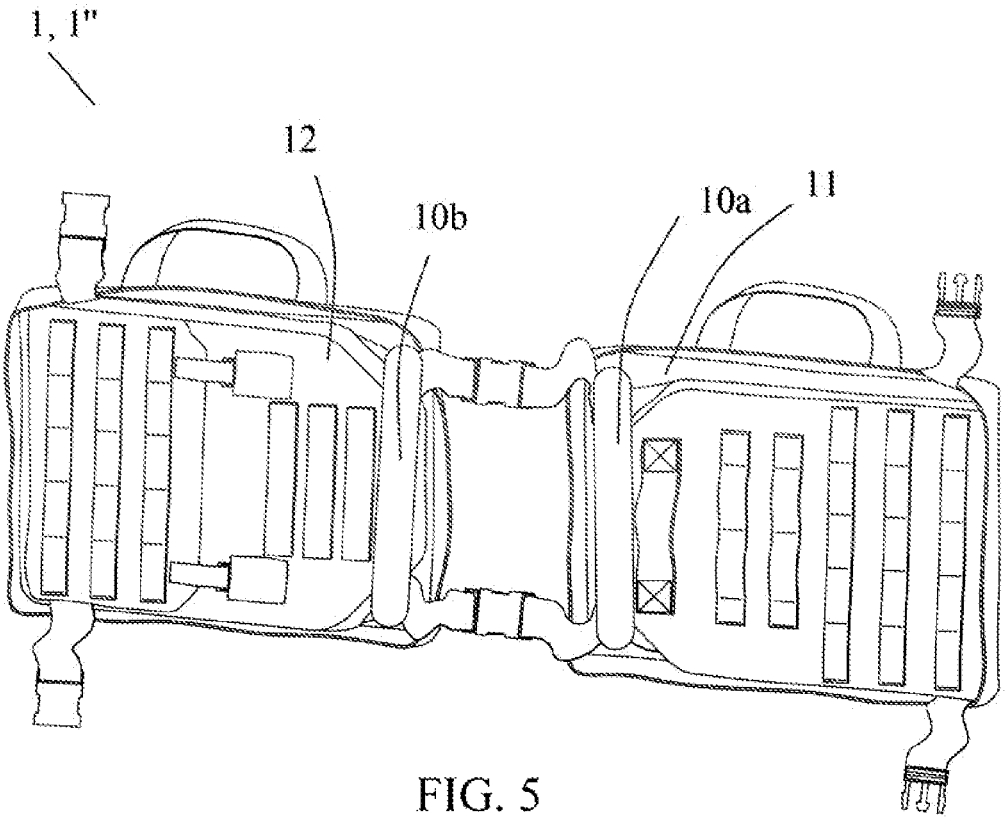
FIG. 5 is a schematic three-dimensional view of a pack type body armor according to still another embodiment of the present disclosure when the pack type body armor is opened, showing that first and second buoyancy elements are respectively disposed inside the first and second pack bodies.

FIG. 5 is a schematic three-dimensional view of a pack type body armor according to still another embodiment of the present disclosure when the pack type body armor is opened. Referring to FIG. 5, the pack type body armor 1 further includes first and second buoyancy elements 10*a* and 10*b* respectively disposed inside the first and second pack bodies 11 and 12. In this way, when a user is drowning, the first and second buoyancy elements 10*a* and 10*b* can provide buoyancy, so that the pack type body armor 1 can be used as a simple life jacket. The first and second buoyancy elements 10*a* and 10*b* can be inflated buoys or an element that is automatically inflated in water (including an airbag or a chemical substance that automatically inflates in water).

A feature of the pack type body armor in the present disclosure is as follows: The pack type body armor has both the function of a pack and the function of a bullet-proof cloth. Further, because the antibacterial material layer of the pack type body armor is disposed near the body of a user, bacterial breeding in the first and second pack bodies caused by sweating of the body of the user can be reduced, thereby further reducing the stink produced by sweating of the user in a conventional bullet-proof cloth. When the user is drowning, first and second buoyancy elements of the pack type body armor can provide buoyancy, so that the pack type body armor can be used as a simple life jacket.

In conclusion, the preferred implementations or embodiments of the technical means adopted in the present disclosure for resolving problems are merely recorded, and are not intended to limit the scope of the present disclosure. Any equivalent change and modification consistent with or made in accordance with the scope of the present disclosure patent shall fall within the scope of the present disclosure patent.

What is claimed is:

1. A pack type body armor, comprising:

first and second pack bodies, each comprising a cut-resistant material layer, a bullet-proof material layer, and an antibacterial material layer arranged in sequence, wherein the antibacterial material layer is disposed on a side near the body of a user, and the antibacterial material layer is made of copper fiber; wherein:

when the pack type body armor has the function of a pack, each side of the first pack body and each side of the second pack body are detachably connected by a first connecting element; and when the pack type body armor has the function of a bullet-proof cloth, the first and second pack bodies are detachably connected by a second connecting element.

2. The pack type body armor according to claim 1, wherein the first connecting element comprises at least one zipper, and the second connecting element comprises two shoulder belts and two waist belts.

3. The pack type body armor according to claim 2, wherein the zipper enables the detachable connection between each side of the first pack body and each side of the second pack body to be an engagement connection.

4. The pack type body armor according to claim 2, wherein the two shoulder belts and two waist belts enable the detachable connection between the first and second pack bodies to be a release-buckle connection or a sticky-buckle connection.

5. The pack type body armor according to claim 1, wherein the first and second pack bodies each further comprise another cut-resistant material layer used for covering the antibacterial material layer.

6. The pack type body armor according to claim 1, wherein the cut-resistant material layer is made of cut-resistant cloth, and the bulletproof material layer is made of ultra-high molecular weight polyethylene fiber.

7. The pack type body armor according to claim 1, further comprising first and second buoyancy elements respectively disposed inside the first and second pack bodies.

8. A pack type body armor, comprising:

first and second pack bodies, each comprising a cut-resistant material layer, a bulletproof material layer, and an antibacterial material layer arranged in sequence, wherein the antibacterial material layer is disposed on a side near the body of a user, and the antibacterial material layer is made of copper fiber;

at least one zipper, configured to detachably connect the first pack body to the second pack body, and disposed on each side of the first pack body and each side of the second pack body; and two shoulder belts and two waist belts, configured to detachably connect the first pack body to the second pack body, wherein the two shoulder belts are first and second shoulder belts, the first and second shoulder belts are both disposed near first sides of the first and second pack bodies, the two waist belts are first and second waist belts, the first waist belt is disposed near second sides of the first and second pack bodies, the second waist belt is disposed near third sides of the first and second pack bodies, and the second sides are opposite to the third sides.

9. The pack type body armor according to claim 8, wherein the cut-resistant material layer is made of cut-resistant cloth, and the bulletproof material layer is made of ultra-high molecular weight polyethylene fiber.

* * * * *